US006212809B1

(12) United States Patent
Gaule

(10) Patent No.: US 6,212,809 B1
(45) Date of Patent: Apr. 10, 2001

(54) APPARATUS FOR SUPPORTING INDICIA WITH A RAIL

(76) Inventor: James Gaule, 1992 Halekoa Dr., Honolulu, HI (US) 96821

( * ) Notice: Subject to any disclaimer, the term of this patent is extended or adjusted under 35 U.S.C. 154(b) by 0 days.

(21) Appl. No.: 09/227,746

(22) Filed: Jan. 8, 1999

(51) Int. Cl.[7] ..... G09F 3/18

(52) U.S. Cl. ..... 40/660; 40/661; 40/661.12; 40/665

(58) Field of Search ..... 40/316, 607, 658, 40/660, 661, 661.12, 665, 666; D20/41

(56) References Cited

U.S. PATENT DOCUMENTS

| | | | | |
|---|---|---|---|---|
| 566,761 | * | 9/1896 | Hosmer | 40/665 X |
| 1,375,685 | | 4/1921 | Ericson . | |
| 1,628,954 | * | 5/1927 | Dedmon | 40/661 |
| 1,765,600 | | 6/1930 | McGilvray . | |
| 1,835,650 | | 12/1931 | Hope . | |
| 2,156,553 | | 5/1939 | Vendope . | |
| 2,507,875 | * | 5/1950 | Williams | 40/607 |
| 2,539,546 | * | 1/1951 | McGuire | 40/607 |
| 2,918,741 | | 12/1959 | Welter et al. . | |
| 3,928,930 | | 12/1975 | Attwood . | |
| 3,986,284 | | 10/1976 | Plantinga . | |
| 4,164,084 | * | 8/1979 | Crockett | 40/660 |
| 4,300,299 | | 11/1981 | Batky et al. . | |
| 4,329,801 | | 5/1982 | Clausen . | |
| 4,367,517 | | 1/1983 | Balzer . | |
| 4,454,671 | | 6/1984 | Morgenstern . | |
| 4,534,126 | | 8/1985 | Gilman . | |
| 4,985,942 | | 1/1991 | Shaw . | |
| 5,020,256 | | 6/1991 | French . | |
| 5,396,740 | | 3/1995 | Bocchi . | |
| 5,487,203 | | 1/1996 | Brach et al. . | |
| 5,560,093 | | 10/1996 | Hutton et al. . | |
| 5,570,541 | | 11/1996 | Hering . | |
| 5,612,665 | | 3/1997 | Gerhardson . | |
| 5,657,886 | | 8/1997 | Tacchella . | |
| 6,042,484 | * | 3/2000 | Streit | 40/660 X |

FOREIGN PATENT DOCUMENTS

| | | | | |
|---|---|---|---|---|
| 2458855 | * | 2/1981 | (FR) | 40/660 |
| 2208450 | * | 3/1989 | (GB) | 40/607 |
| 568001 | * | 10/1957 | (IT) | 40/607 |
| 31687 | * | 12/1933 | (NL) | 40/660 |

* cited by examiner

*Primary Examiner*—Brian K. Green
(74) *Attorney, Agent, or Firm*—Parsons & Goltry; Robert A. Parsons; Michael W. Goltry

(57) ABSTRACT

Apparatus for supporting indicia with a rail comprising a receptacle enclosing a predetermined length of the rail and indicia supported by the receptacle adjacent the rail for viewing.

22 Claims, 3 Drawing Sheets

APPARATUS FOR SUPPORTING INDICIA WITH A RAIL

FIELD OF THE INVENTION

This invention relates generally to the field of indicia supporting apparatus and, more particularly, to apparatus and methods of supporting indicia with a rail carried by supports.

BACKGROUND OF THE INVENTION

Advertising has long enjoyed considerable innovation by skilled artisans in an effort to efficiently, inexpensively and easily communicate advertising medium to consumers. Although television and radio embody exemplary mechanisms for communicating advertising messages to consumers, they prove very expensive and, for some, prohibitively expensive. Less expensive means of advertising, such as billboards and yellow page advertising, however, prove largely ineffective as an efficient and cost-effective means of advertising. In view of the present apparatus and methods for presenting advertisements to consumers, the need for certain new and useful innovations for reducing the cost and increasing the effectiveness of advertising is evident.

Accordingly, it would be highly desirable to provide improved apparatus and methods for supporting indicia and, more particularly, for supporting advertising indicia.

It is a purpose of the present invention to provide new and improved apparatus for supporting indicia that is easy to construct.

It is another purpose of the present invention to provide new and improved apparatus for supporting indicia that is inexpensive.

It is still another purpose of the present invention to provide new and improved apparatus for supporting indicia that is highly effective for delivering and communicating indicia to consumers.

It is a further purpose of the present invention to provide new and improved apparatus for supporting indicia that may be easily and inexpensively installed with conventional railings.

It is still a further provision of the present invention to decrease the costs of advertising.

It is yet still a further provision of the present invention to provide small business owners and entrepreneurs with an inexpensive alternative to advertising as compared with television, radio and billboard advertising.

It is another purpose of the present invention to provide new and improved apparatus for supporting indicia that is easy to use.

It is still another purpose of the present invention to provide new and improved apparatus for supporting indicia that may be used outside and inside.

SUMMARY OF THE INVENTION

The above problems and others are at least partially solved and the above purposes and others are realized in new and improved apparatus for supporting indicia with a rail. In a particular embodiment, apparatus of the present invention comprises a receptacle movable between an open condition for receiving a predetermined length of the rail and a closed condition for enclosing the predetermined length of the rail, and indicia contained by the receptacle adjacent the rail for viewing in the closed condition of the receptacle. The receptacle may contain a window for allowing the indicia to be viewed when supported by the receptacle adjacent the rail in its closed condition.

BRIEF DESCRIPTION OF THE DRAWINGS

The foregoing and further and more specific objects and advantages of the instant invention will become readily apparent to those skilled in the art from the following detailed description thereof taken in conjunction with the drawings in which.

DETAILED DESCRIPTION OF A PREFERRED EMBODIMENT

The present invention provides, among other things, apparatus and methods for supporting indicia with railing. Ensuing embodiments of the present invention are easy and inexpensive to construct, easy to install and prove exemplary as a mechanism for presenting advertising indicia to consumers, and for protecting the advertising indicia from damage such as through exposure to sunlight, water, etc.

Figure 1:
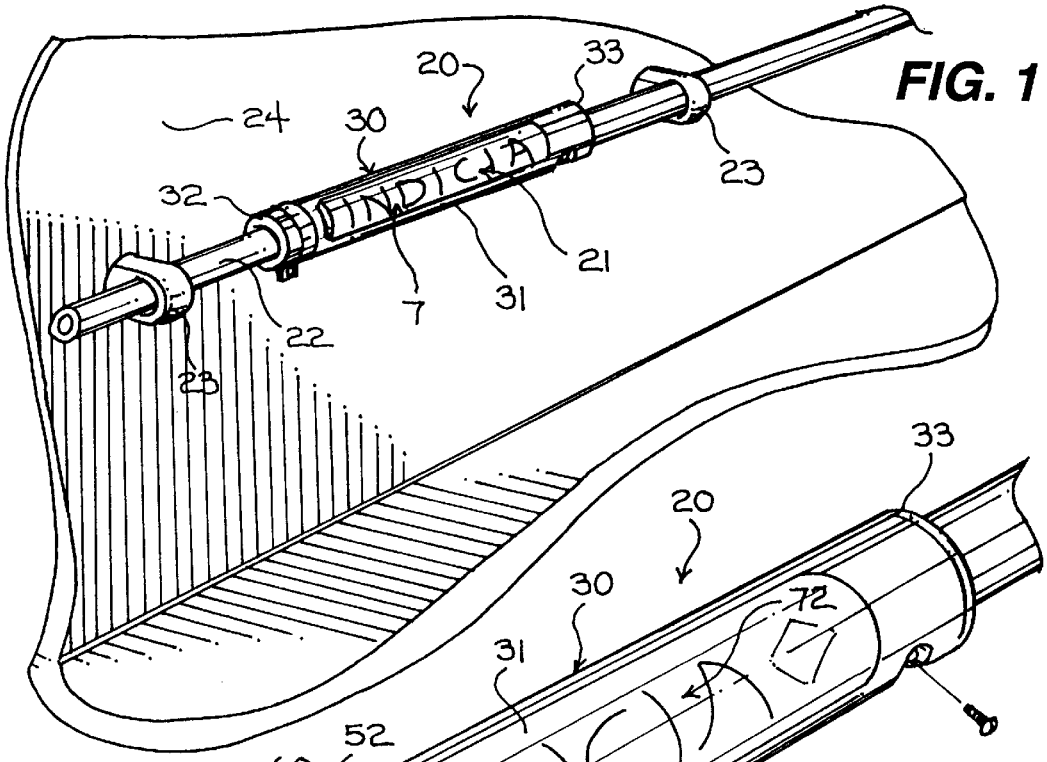
FIG. 1 is an isometric view of apparatus for supporting indicia with a rail carried by supports, the apparatus including a receptacle and indicia supported by the receptacle adjacent the rail.
Figure 2:
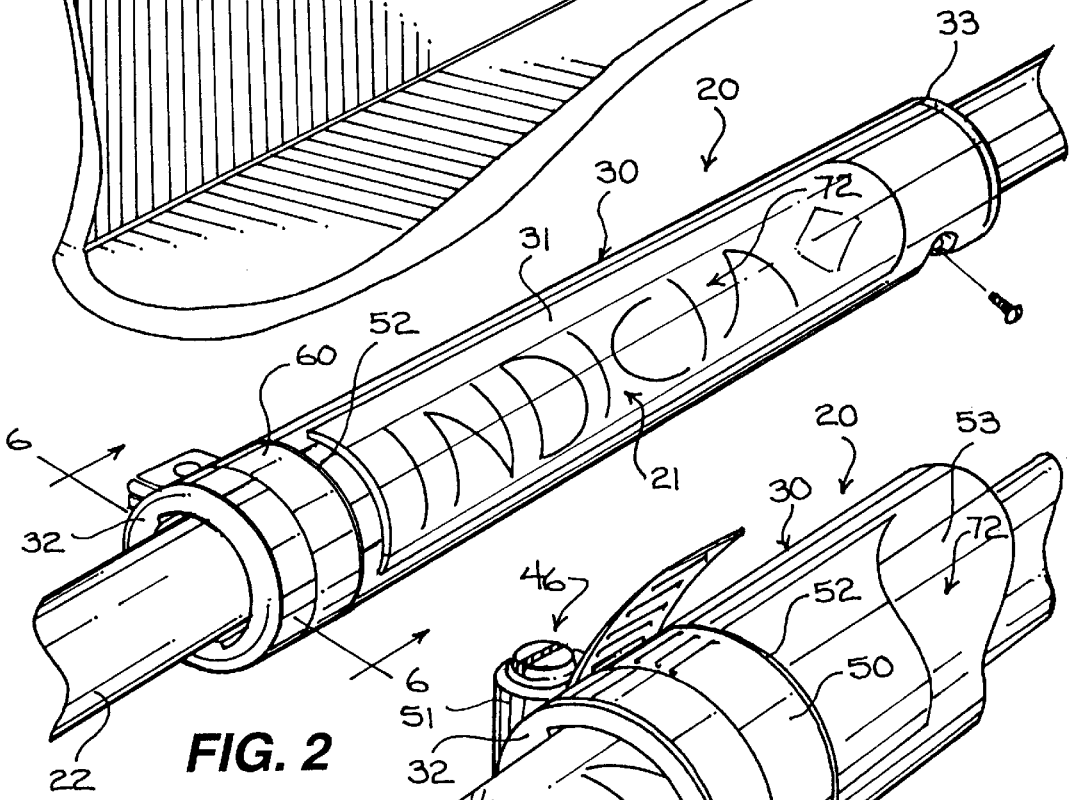
FIG. 2 is an enlarged isometric view of the apparatus of FIG. 1 shown carried by the rail.
Figure 3:
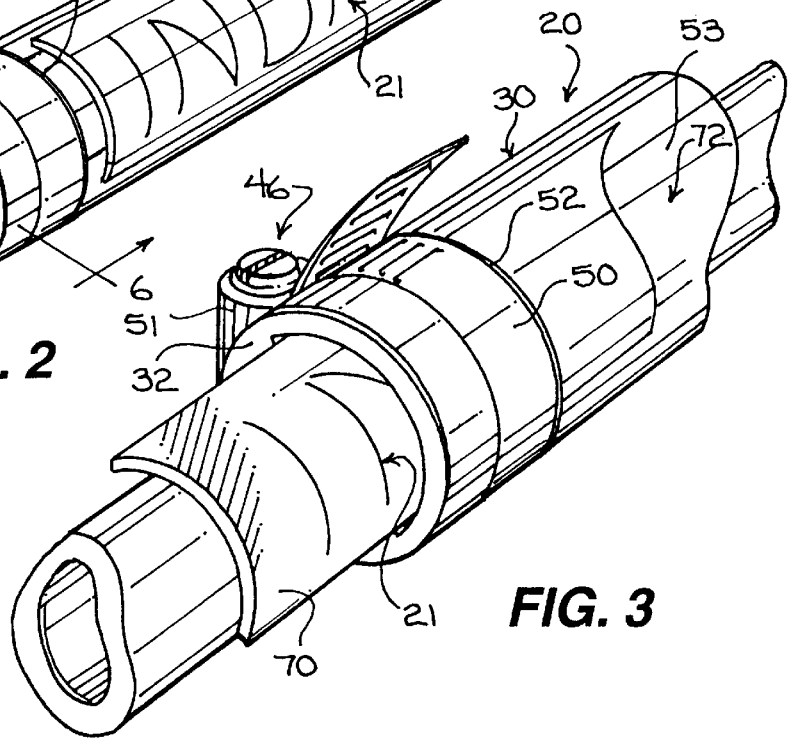
FIG. 3 is an enlarged fragmented isometric view of a free end of the apparatus of FIG. 1 and the indicia shown carried by a medium.
Figure 4:
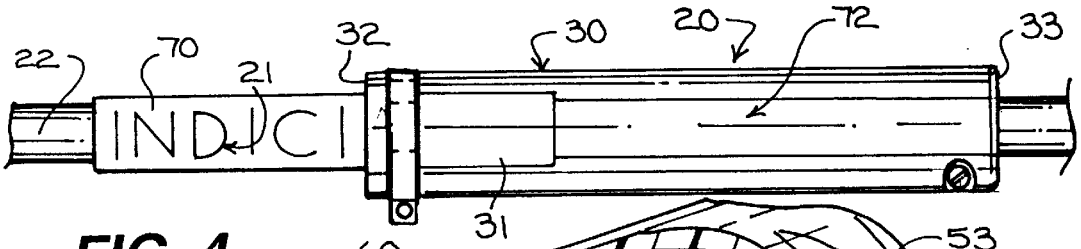
FIG. 4 is a front elevational view of the apparatus of FIG. 1 with the indicia shown as it would appear partially enclosed by the receptacle.
Figure 6:
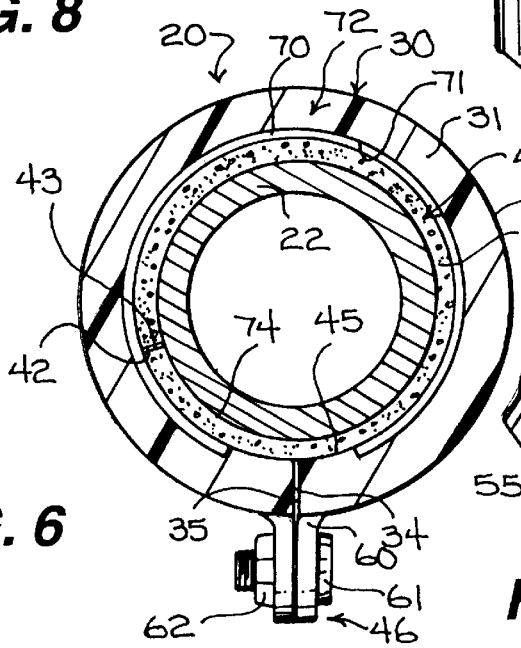
FIG. 6 is a vertical sectional view taken along line 66 of FIG. 2.

Turning now to the drawings, in which like reference characters indicate corresponding elements throughout the several views, attention is first directed to FIG. 1 which illustrates an isometric view of apparatus 20 for supporting indicia 21 with a rail 22 of a type shown supported with a wall 24 at an elevated location. In this specific embodiment, rail 22 is shown carried by supports 23 mounted with wall 24. It will readily occur to those skilled in the art that supports 23 are shown merely for the purposes of illustration, and that other mechanisms for supporting rails of a type like rail 22 may be employed if desired. Turning to FIG. 6, apparatus 20 comprises a receptacle 30 including a sidewall 31 having first and second free ends 32 and 33 (FIGS. 1, 2, and 3). Sidewall 31 is severed to form first and second edges 34 and 35 each extending from the first free end 32 to the second free end 33. Receptacle 30 is preferably constructed of a substantially resilient material, such as caste or extruded acrylic or polycarbonate, to allow it to be moved between an open condition with the first and second edges 34 and 35 disposed in space relation to allow rail 22 to pass therethrough, and a closed condition to enclose a predetermined length of rail 22 as shown in FIGS. 1, 2, and 4. In the closed condition, sidewall 31 is substantially continuous and first and second edges 34 and 35 mate. First and second edges 34 and 35 may be made to overlap in the closed condition of receptacle 30 and, more particularly, may be made to overlap in substantially sealing engagement.

Figure 5:
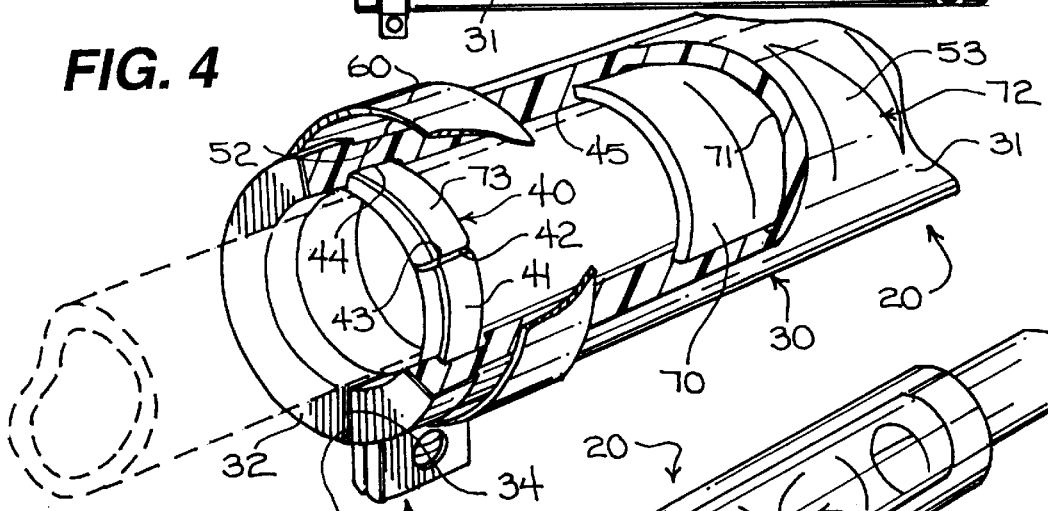
FIG. 5 is a fragmented isometric view of the apparatus of FIG. 1 with portions thereof broken away for the purposes of illustration.

In its closed condition to enclose a predetermined length of rail 22, receptacle 30 is preferably sealingly engagable to thereby sealingly enclose the predetermined length of rail 22. In this regard, and with attention directed to FIG. 5, shown is a gasket 40. Gasket 40 is of a conventional sort and includes a ring 41 that has been severed to form opposing first and second free ends 42 and 43. Ring 41 is preferably constructed of a selected rubber or the like and is normally carried in a groove 44 formed in an inner or first major surface 45 of sidewall 31 facing rail 22 in its closed condition. Like sidewall 31, ring 41 may be moved between open and closed conditions for receipt and engagement with rail 22. With gasket 40 carried in groove 44, it will face and bear against rail 22 so as to be captured between sidewall 31 and rail 22.

To seal first free end 32 of receptacle 30 with rail, clamp apparatus 46 may be engaged for bearing first free end 32 against rail 22 for sealingly engaging gasket 40 against first major surface 45 and rail 22. In this specific embodiment, clamp apparatus 46 comprises a well-known assemblage including an elongate band 50 engagable in a continuous condition and a threaded adjustment element 51 carried by the elongate band 50. A groove 52 formed in an outer or second major surface 53 of sidewall 31 adjacent first free end 32 receives and accommodates elongate band 50 in its continuous condition, wherein the threaded adjustment element 51 may be adjusted for constricting elongate band 50 against sidewall 31 for bearing first free end 32 against rail 22 for sealingly engaging gasket 40 against first major surface 45 and rail 22. Elongate band 50 may be constructed of a selected metal, plastic or other suitably strong material. As shown in FIGS. 2 and 5, clamp apparatus 46 may alternatively comprise an elongate band 60 receivable by groove 52 and having free ends engagable by a threaded element or bolt 61 and a nut 62 so as to be continuous. It will be understood that elongate band 60 is sized such that in its continuous condition, it will bear first free end 32 against rail 22 for sealingly engaging gasket 40 against first major surface 45 and rail 22.

Figure 7:
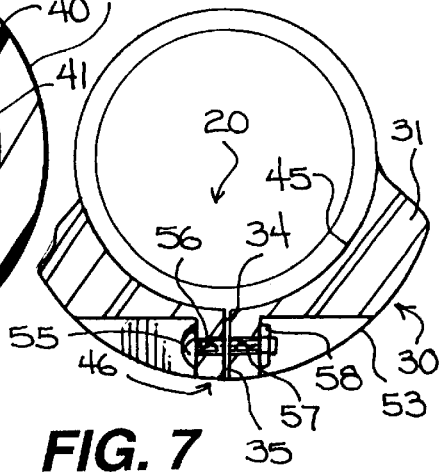
FIG. 7 is a vertical sectional view of the receptacle of FIG. 1 with fastening apparatus shown engaged to enclosed the receptacle in a closed condition.
Figure 10:
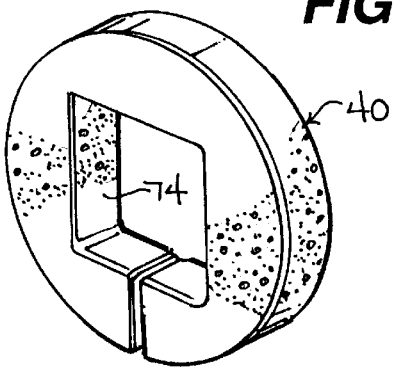
FIG. 10 is an isometric view of a gasket engagable for sealingly engaging the receptacle with the rail of FIG. 9.

Regarding FIG. 7, clamp apparatus 46 may be provided as a threaded element or bolt 55 receivable by opposing apertures 56 and 57 carried by sidewall 31 at first and second free edges 34 and 35, respectively, adjacent first free end 32, and a nut 58. With threaded element 55 received into and through apertures 56 and 57, nut 58 may be threadably engaged with threaded element 55 and tightened for bearing first free end 32 against rail 22 for sealingly engaging gasket 40 against first major surface 45 and rail 22. Each embodiment of clamp apparatus 46 may be removed by reversing the steps necessary to carry out their respective installations.

Although not shown, it will be understood that second free end 33 is provided with a gasket and clamp apparatus like that of first free 32 for allowing a user to sealing engage second free end 33 with rail 22.

Apparatus 20 supports indicia 21 such that with receptacle 30 mounted with rail in its closed condition, may be easily viewed as shown in FIGS. 1 and 2. In the specific embodiment set forth in FIGS. 3 and 4, indicia 21 is carried by a medium 70 of which may be contained and supported by receptacle 30 adjacent rail 22 so as to be viewable. Medium 70 may be constructed of any desired material such as paper, plastic, a selected metal, cardboard or other material upon which indicia may be carried and expressed.

In accordance with a preferred manner of installation, and with attention directed to FIG. 6, medium 70 is normally carried in a recess 71 formed in first major surface 45 of sidewall 31 such that with sidewall 31 mounted with rail 22 in its closed condition, medium 70 will reside against or otherwise adjacent rail 22 intermediate the first and second free ends 32 and 33 and indicia 21 will face recess 71. Medium 70 may be carried by recess 71 during installation of sidewall 31. To permit the viewing of indicia 21 so supported with rail by receptacle 30, sidewall 31 is preferably constructed to be substantially transparent at least to an extent sufficient to allow the viewing of indicia 21 when contained by receptacle 30. Accordingly, it will be generally understood that sidewall 31 contains or otherwise defines a substantially transparent window 72 (FIGS. 1–6) in opposition to indicia 21 to permit the viewing of indicia when contained by receptacle 30. When sealingly engaged with rail 22, receptacle will operate to contain and protect medium 70 and indicia 21 from exposure to external environmental conditions.

As evinced in FIGS. 3 and 4, medium 70 is preferably removable so that it may be replaced with any desired indicia as a user may desire. In this regard, clamp 46 apparatus 46 may be released, medium 70 grasped and removed from one of the first and second free ends 32 and 33 of receptacle 30 and then replaced with medium having different indicia, and then clamp apparatus 46 tightened for sealingly engaging receptacle 30 with rail 22. If a user should desire, indicia 21 may be supported by receptacle 30 in a substantially permanent fashion such that when mounted with rail 22 in its closed condition, receptacle 30 will support indicia adjacent rail 22 for viewing consistent with the teachings of this disclosure. In this regard, sidewall 31 may be provided to support indicia substantially permanently with indicia either substantially permanently affixed to sidewall 31 or embedded or otherwise contained by sidewall 31 or imprinted on sidewall 31.

Figure 9:
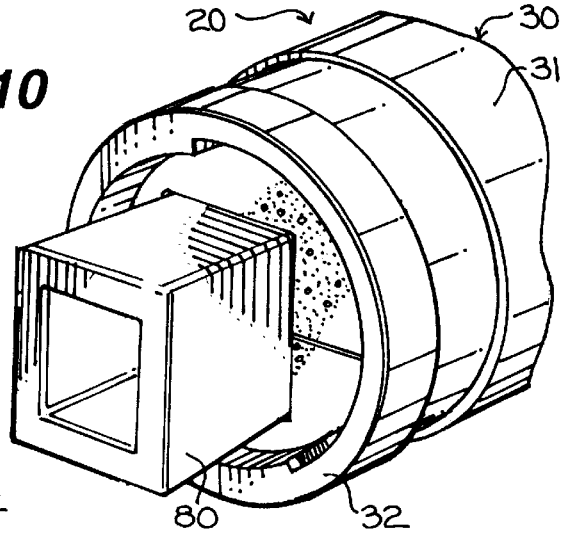
FIG. 9 is a fragmented isometric view of the apparatus of FIG. 1 shown as it would appear carried by a rail having a substantially square cross section.

Rail 22 is shown having a substantially cylindrical shape. To provide for exemplary sealing engagement, ring 41 of gasket 40 includes an outer surface 73 (FIG. 5) shaped for conforming substantially with groove 44 and inner surface 74 shaped as substantially circular or cylindrical for conforming substantially with the substantially cylindrical shape of rail 22 in its closed condition. FIG. 9 illustrates a rail 80 having a substantially square cross-sectional shape. To provide for exemplary sealing engagement, inner surface 74 of gasket 40 is shown shaped as substantially square for conforming substantially with the substantially square shape of rail 80 in its closed condition. The skilled artisan will readily appreciate that gaskets may be provided in any desired shape suitable for facilitating the sealing engagement of the first and second free ends 32 and 33 of receptacle 30 with a rail.

Figure 11:
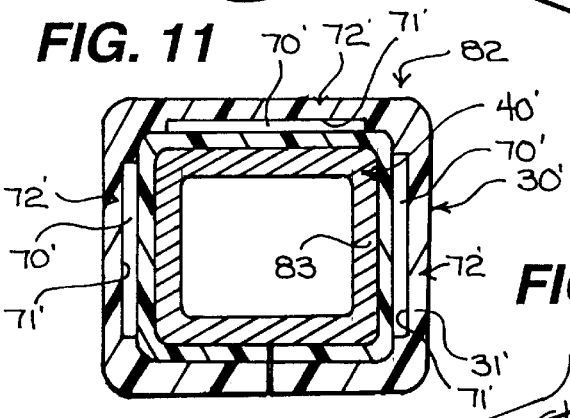
FIG. 11 is a vertical sectional view of apparatus for supporting indicia with a rail, the apparatus shown having a substantially square cross-sectional shape.

The cross-sectional shape of the receptacle 30 and the associated gaskets may be provided in a variety of geometric shapes depending on specific needs. The various structural components of apparatus 20 are shown in the above-described drawings as having substantially cylindrical or circular cross-sectional shapes. Regarding FIG. 11, shown is a vertical sectional view of apparatus 82 for supporting indicia with a rail 83. The specific structural features of apparatus 82 are substantially identical to that of apparatus 20. Accordingly, the same reference characters used to describe apparatus 20 will be used to describe apparatus 82. However, common reference characters used to describe apparatus 82 will include a prime ("') symbol for clarity. In this regard, and unlike apparatus 20, 21 receptacle 30' and gaskets 40' (only one shown) have substantially square cross sectional shapes designed to conform substantially with the substantially square cross sectional shape of rail 83.

Receptacle 30' carries not one, but rather a plurality of recesses 71' each for receiving one of a plurality of media 70' expressing indicia. Consistent with the general teachings of the present invention, it will be generally understood that sidewall 31' contains or otherwise defines substantially transparent windows 72' in opposition at least to the indicia carried by each of the media 70' to permit the viewing of each indicia when contained by receptacle 30'. Like sidewall 31, the entire extent of sidewall 31' may be totally substantially transparent if desired.

Figure 12:
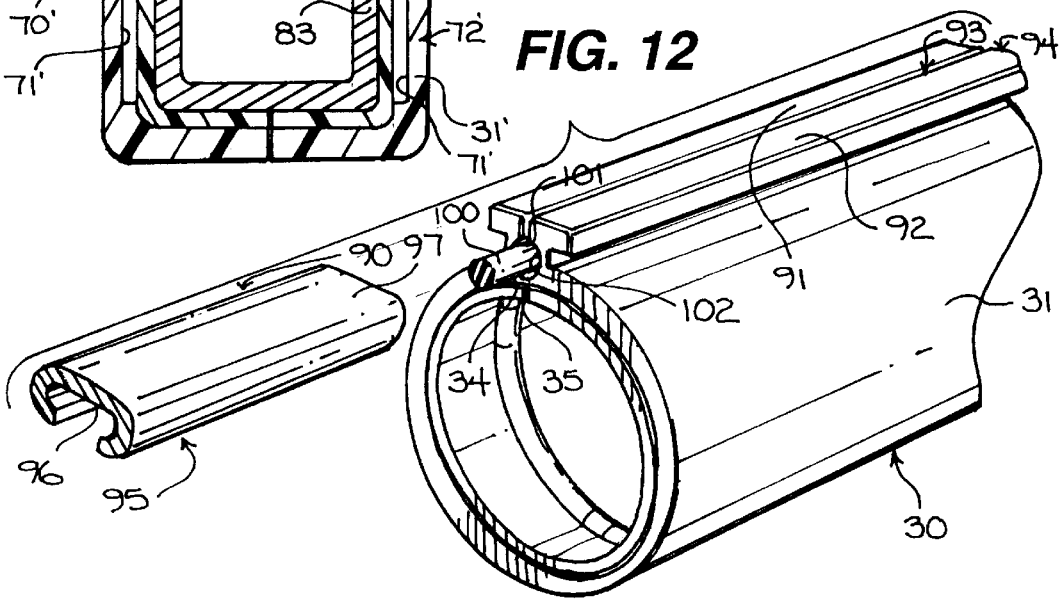
FIG. 12 is fragmented isometric view of an engagement assembly for sealingly engaging edges of the receptacle of the present invention in a closed condition.

Turning to FIG. 12, sidewall 31 is shown having engagement apparatus 90 operative for substantially sealingly engaging first and second edges 34 and 35 of sidewall together. This can be important for it will ensure against water entering between the first and second edges 34 and 35 to damage the indicia. Engagement apparatus 90 includes a first engagement element halve 91 carried by, and extending outwardly from, first edge 34, and a second engagement element halve 92 carried by, and extending outwardly from, second edge 35. In the closed condition of receptacle 30, the first and second engagement elements 91 and 92 mate to form an engagement element 93 shown, in this specific example, as a tongue 94. A complemental engagement element 95 is detachably engagable with tongue 94 for substantially sealingly first and second edges 34 and 35 together. Because engagement element 93 is a tongue 94, complemental engagement element 95 includes a groove 96 carried by an elongate support body 97 that receives and captures tongue 94.

To enhance the sealing engagement of first and second edges 34 and 35, engagement apparatus 90 may further include an elongate seal 100 that may be positioned so as to be captured between the first and second engagement element halves 91 and 92 in first and second grooves 101 and 102 carried by first and second engagement element halves 91 and 92. With complemental engagement element 95 engaged with engagement element 93, elongate seal 100 will be captured by the first and second grooves 101 and 102 between the first and second engagement element halves 91 and 92 in sealing engagement. Like gaskets 40, elongate seal 100 may be constructed of rubber or other suitable material sufficient to occasion sealing engagement.

Figure 8:
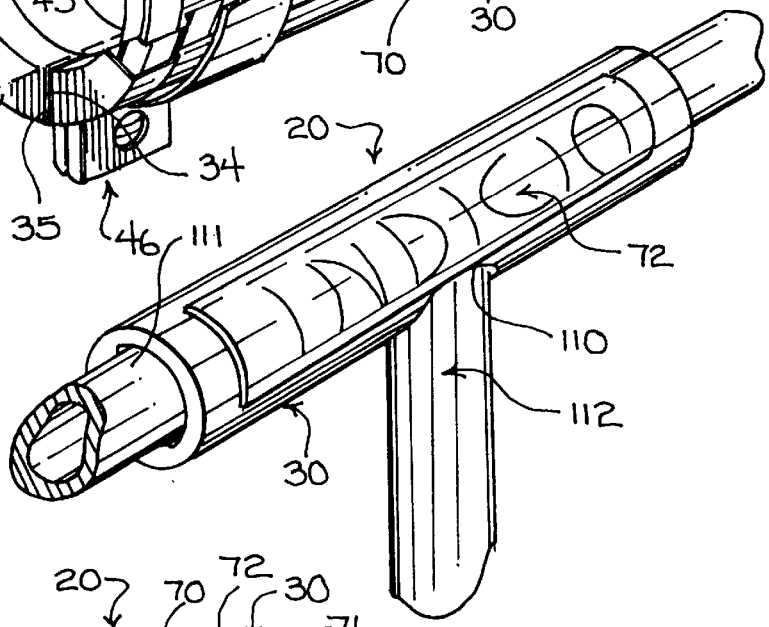
FIG. 8 is an isometric view of the apparatus of FIG. 1 shown as it would appear mounted to a rail having a T-junction.

The present invention has been described above with reference to a preferred embodiment. However, those skilled in the art will recognize that changes and modifications may be made in the described embodiments without departing from the nature and scope of the present invention. For instance, FIG. 8 illustrates an opening 110 formed through sidewall 31 of receptacle 30 to allow installation of apparatus 20 with a rail 111 at a T-junction 112. Furthermore, when weather is not a consideration, such as inside a building, the various gaskets used for sealing may be eliminated. Also, the various embodiments may be constructed of varying size suitable for accommodating rails of varying size, and the various embodiments of clamp apparatus 46 may be made to blend with receptacle ergonomically to inhibit peoples' clothing or extremities from snagging or catching on clamp apparatus 46 as they walk by or should they touch apparatus 20. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. Apparatus supporting indicia with a rail, comprising:

a receptacle having a length, an inner surface and an outer surface, enclosing a predetermined length of the rail, the inner surface of the receptacle closely engaging the rail along the entire length of the receptacle to provide support along the entire length of the receptacle;

indicia directly positioned on and supported by the inner surface of the receptacle adjacent the rail for viewing; and sealing means included in the receptacle for sealingly enclosing the predetermined length of the rail and protecting the indicia from exposure to external environmental conditions.

2. Apparatus of claim 1, wherein the receptacle includes a window through which the indicia may be viewed.

3. Apparatus of claim 1, wherein the indicia is carried by a medium.

4. Apparatus of claim 1, wherein the indicia is supported between the receptacle and the rail.

5. Apparatus of claim 1, wherein the indicia is supported between the receptacle and the rail by a recess carried by the receptacle.

6. Apparatus supporting indicia with a rail, comprising:

a receptacle having a length, an inner surface and an outer surface, the receptacle being movable between an open condition receiving a predetermined length of the rail and a closed condition for enclosing the predetermined length of the rail, with the inner surface of the receptacle closely engaging the rail along the entire length of the receptacle to provide support along the entire length of the receptacle in the closed condition;

indicia directly positioned on and supported by the inner surface of the receptacle adjacent the rail for viewing in the closed condition of the receptacle; and sealing means included in the receptacle for sealingly enclosing the predetermined length of the rail and protecting the indicia from exposure to external environmental conditions.

7. Apparatus of claim 6, wherein the receptacle comprises a sidewall having edges that mate in the closed condition of the receptacle.

8. Apparatus of claim 7, wherein the edges each carry an engagement element halve that mate to form an engagement element in the closed condition of the receptacle.

9. Apparatus of claim 8, further including a complemental engagement element detachably engagable with the engagement element for detachably securing the edges of the receptacle together in the closed condition.

10. Apparatus of claim 9, wherein the engagement element comprises a tongue.

11. Apparatus of claim 10, wherein the complemental engagement element comprises a groove carried by an elongate support body.

12. Apparatus of claim 6, wherein the receptacle includes a window through which the indicia may be viewed in the closed condition.

13. Apparatus of claim 6, wherein the indicia is carried by a medium supported adjacent the rail for viewing in the closed condition of the receptacle.

14. Apparatus of claim 6, wherein the indicia is carried by a medium supported adjacent the rail for viewing through a window carried by the receptacle in the closed condition.

15. Apparatus of claim 6, wherein the indicia is supported between the receptacle and the rail in the closed condition of the receptacle.

16. Apparatus of claim 6, wherein the indicia is supported between the receptacle and the rail by a recess carried by the receptacle closed condition of the receptacle.

17. Apparatus supporting indicia with a rail, comprising:

a receptacle movable between an open condition receiving a predetermined length of the rail and a closed condition enclosing the predetermined length of the rail, the receptacle having a length extending between free ends, an inner surface and an outer surface, with the inner surface of the receptacle closely engaging the rail along the entire length of the receptacle to provide support along the entire length of the receptacle in the closed condition;

indicia directly positioned on and contained by the inner surface of the receptacle adjacent the rail intermediate the free ends for viewing in the closed condition of the receptacle; and sealing means included in the receptacle for sealingly enclosing the predetermined length of the rail and protecting the indicia from exposure to external environmental conditions.

18. Apparatus of claim 17, wherein the receptacle includes a window intermediate the ends thereof for viewing the indicia in the closed condition.

19. Apparatus of claim 17, wherein the indicia is carried by a medium removably supported adjacent the rail in the closed condition of the receptacle for viewing through a window carried by the receptacle intermediate the free ends.

20. Apparatus of claim 17, wherein the receptacle comprises a sidewall movable between the open condition and the closed condition so as to be substantially continuous.

21. Apparatus of claim 17, wherein the sealing means includes:

a gasket sealingly receivable between the rail and the receptacle adjacent one of the free ends of the receptacle in the closed condition; and another gasket sealingly receivable between the rail and the receptacle adjacent the other one of the free ends of the receptacle in the closed condition.

22. Apparatus of claim 17, further including clamp apparatus engagable with the receptacle in the closed condition adjacent each one of the free ends for bearing the free ends against the rail in sealing engagement.

* * * * *

UNITED STATES PATENT AND TRADEMARK OFFICE

CERTIFICATE OF CORRECTION

PATENT NO. : 6,212,809 B1
DATED : April 10, 2001
INVENTOR(S) : Gaule, James

It is certified that error appears in the above-identified patent and that said Letters Patent is hereby corrected as shown below:

Column 5,
Line 12, please remove "21".

Signed and Sealed this

Twenty-sixth Day of February, 2002

*Attest:*

*Attesting Officer*

JAMES E. ROGAN
*Director of the United States Patent and Trademark Office*